United States Patent [19]

Brännström

[11] Patent Number: 4,640,205

[45] Date of Patent: Feb. 3, 1987

[54] METHOD OF DRYING GRANULAR FUEL IN A FLUIDIZED BED COMBUSTION PLANT AND A COMBUSTION PLANT WITH A DRYING DEVICE

[75] Inventor: Roine Brännström, Finspong, Sweden

[73] Assignee: Asea Stal AB, Västerås, Sweden

[21] Appl. No.: 751,095

[22] Filed: Jul. 2, 1985

[30] Foreign Application Priority Data

Jul. 11, 1984 [SE] Sweden ..... 8403665

[51] Int. Cl.[4] ..... F22B 1/00

[52] U.S. Cl. ..... 110/347; 110/106; 110/238; 432/14

[58] Field of Search ..... 110/341, 342, 347, 248, 110/245, 224, 232, 106, 238; 432/14, 106

[56] References Cited

U.S. PATENT DOCUMENTS

| | | | |
|---|---|---|---|
| 2,849,968 | 9/1958 | Krug | 110/106 |
| 3,833,943 | 9/1974 | Sturtevant | 110/238 |
| 4,059,060 | 11/1977 | Gambs et al. | 110/106 |
| 4,153,411 | 5/1979 | Isheim | 110/238 |
| 4,159,682 | 7/1979 | Fitch et al. | 110/216 |
| 4,270,279 | 6/1981 | Roediger . | |
| 4,274,836 | 6/1981 | Ban et al. . | |
| 4,355,601 | 10/1982 | Hattiangadi | 110/245 |
| 4,361,100 | 11/1982 | Hinger | 110/238 |
| 4,387,654 | 6/1983 | Binasik et al. | 110/347 |
| 4,397,248 | 8/1983 | Mehta | 110/106 |
| 4,411,204 | 10/1983 | Hamilton | 110/106 |
| 4,411,879 | 10/1983 | Ehrlich et al. | 110/263 |
| 4,416,418 | 11/1983 | Goodstine et al. | 122/4 D |
| 4,421,036 | 12/1983 | Brannstrom et al. | 110/263 |
| 4,424,766 | 1/1984 | Boyle | 110/245 |
| 4,434,726 | 3/1984 | Jones | 110/347 |
| 4,446,799 | 5/1984 | Andersen | 110/263 |
| 4,476,790 | 10/1984 | Borio et al. | 110/263 |

FOREIGN PATENT DOCUMENTS

| | | |
|---|---|---|
| 292541 | 7/1915 | Fed. Rep. of Germany . |
| WO84/00976 | 8/1983 | PCT Int'l Appl. . |
| 434087 | 7/1984 | Sweden . |

*Primary Examiner*—Henry C. Yuen

*Attorney, Agent, or Firm*—Pollock, Vande Sande & Priddy

[57] ABSTRACT

The conveying properties of a particulate fuel during pneumatic transportation to a fluidized bed in a combustion plant, are improved by at least surface drying of the fuel. A calcium-containing bed material is withdrawn from the bed under such conditions that the bed material is calcined to form CaO. This withdrawn bed material is crushed and mixed with fuel, whereby the CaO absorbs water from the fuel in an exothermic reaction forming calcium hydroxide, $Ca(OH)_2$, the released heat evaporating moisture from the fuel. The fuel particles will have reduced surface moisture which reduces the risk of clogging during pneumatic feeding of fuel to a combustion chamber. Due to the intimate contact between the fuel particles and the crushed bed material, the tendency towards reaction between sulfer in the fuel and the bed material increases.

16 Claims, 3 Drawing Figures

METHOD OF DRYING GRANULAR FUEL IN A FLUIDIZED BED COMBUSTION PLANT AND A COMBUSTION PLANT WITH A DRYING DEVICE

TECHNICAL FIELD (a) Background of the Invention

This invention relates to a method of drying granular fuel, typically crushed coal, in a fluidized bed combustion plant whose particulate bed material contains calcium for the absorption of sulfer from the fuel. The bed material may at least partially consist of granular limestone or dolomite. The invention seeks to impart improved conveying properties when the fuel is pneumatically fed to the bed, so that the risk of clogging of the conveying pipe is prevented because of the moisture content of the fuel. The method of the invention is particularly intended for a power plant with a pressurized fluidized bed, a so-called PFBC (Pressurized Fluidized Bed Combustion) plant.

The invention also relates to a combustion plant provided with equipment for utilizing the method.

(b) Discussion of the Prior Art

Ordinary coal for firing power stations normally has such a high water content that it has to be dried to some extent if it is to be transported pneumatically without the risk of the pipes conveying the fuel becoming clogged, thereby resulting in a shut-down of the station. Some degree of drying of the coal is also desirable since large amounts of energy are consumed in evaporating the water included in the fuel.

However, large quantities of energy are consumed in drying of the fuel. Attempts have been made to use low-grade energy, which cannot otherwise be usefully utilized, for this purpose. Thus fuel drying can be effected using waste heat from the flue gases extracted in an air preheater or economizer. When the available heat content in the flue gases is insufficient, flue gases for the drying may be extracted upstream of the air preheater or the economizer, or extra heat can be extracted from steam in a steam plant included in the power station. In the latter case, the efficiency of the whole plant is reduced. The use of low-grade heat energy, that is, drying the fuel at a low temperature, means that the drying plant may have large dimensions and is therefore expensive to provide. When drying coal having a high content of volatile constituents, the drying operation results in some of these volatile combustible constituents escaping with the evaporated-off moisture. Naturally, the calorific value of the coal decreases with the loss of volatile components and this loss increases with increasing drying temperature so that the lowest possible drying temperature is desirable to minimize the escape of volatile components during drying.

From German Patent Specification No. 292,541 it is known to dry a moist fuel by mixing it with quick lime, CaO, which by an exothermic reaction with water in the fuel forms $Ca(OH)_2$, aids in evaporating water from the coal by means of the heat energy released during the slaking of the quick lime.

German Patent Specification No. OS 2,948,893 describes a method of improving the properties of pulverized coal pellets. By the addition of, for example, quick lime, CaO, the properties of the pressed pellets are improved so that the absorption of moisture and consequent undesirable swelling of the pellets during storage and use is reduced.

As sulfer absorbent in a fluidized bed it is known to use a calcium material, usually dolomite or limestone. Dolomite is more favorable than limestone from the point of view of absorption and is preferred to limestone whenever available—in spite of the fact that the content of calcium in limestone is higher than in dolomite.

The bed material is granular, the granular size in fresh bed material normally being below 5 mm. During combusiton of a sulfer-containing carbon, the sulfer reacts with the bed material and a layer of calcium sulfate, gypsum ($CaSO_4$) is formed on the surface of the grains. As the thickness of the layer increases, the absorption capacity is reduced. For this reason, the bed material can be discharged, crushed and returned to the bed, where at least part of the bed material, which has not yet been used for absorption, may come into close contact with sulfer and can thus be utilized. The extent to which this crushed, fine-grained bed material absorbs sulfer depends on the time during which it is in contact with the combustion gases, that is, the dwell time in the bed before it leaves the bed together with the combustion gases.

A plant for returning crushed bed material to the combustion chamber, seperately or together with crushed coal, is described in Brännström et al U.S. Pat. No. 4,421,036.

When withdrawing bed material, the unconsumed part is calcined to a larger or smaller extent, that is, quick lime is obtained $$CaCO_3 \rightarrow CaO + CO_2.$$

The calcination can be controlled so that the desired degree of calcination is obtained by an appropriate selection of temperature and atmosphere in a reaction zone in a discharge device. If the bed material, after withdrawal, passes a zone with a low $CO_2$ content at a temperature of 700 to 800° C., or thereabove, the greater part of the bed material can be calcined. How the discharge device is designed and how the cooling is performed determine the degree of calcination. During this decomposition, heat is consumed at a level of about 65 kJ/mole. The decomposition this involves a heat loss. A simple discharge device which allows a cooling of the bed material by heat exchange with combustion air prior to its passage to the bed, provides a high degree of calcination and, therefore, a high heat consumption. Bed material which has to be disposed of must be slaked. Thus, calcination involves a heat loss when disposing of the bed material.

SUMMARY OF THE INVENTION

According to the invention, calcined or partially calcined bed material, that is, bed material containing quick lime, CaO, is utilized as a drying agent for moist fuel. Fuel and bed material are mixes, for example, in a rotary dryer, which can also be supplied with drying gas. Either the bed material can be crushed or ground and mixed with crushed or ground fuel, or uncrushed bed material may be mixed with lump fuel and the bed material and fuel then curshed or ground together. The mixture of bed material and fuel is fed together into the fluidized bed of the combustion chamber by means of a pneumatic conveying device. Suitably, the bed material is finely crushed so that 90% thereof has a grain size less than 0.1 mm. Quick lime, which is very reactive with water, will upon contact with coal granules bind the readily accessible surface moisture to form $Ca(OH)_2$.

For good contact between coal granules and CaO, it is important for the bed material to be finely crushed or ground and for the mixing to be carefully performed. Unconsumed absorbent absorbs sulfer and is separated together with the ash in a gas cleaner, usually of cyclone type.

During the mixing, part of the moisture in the fuel is chemically bound, which results in the release of heat and in the recovery of the heat energy consumed during the calcination. As a consequence of this heat release, part of the moisture is also evaporated. By allowing flue gases to flow through the drying cylinder, the escaping moisture may be removed and additional drying energy supplied.

The drying can be carried out at a relatively low temperature. This results in insignificant loss of volatile components from the fuel. Complete drying is not necessary. It is primarily the surface moisture that needs to be removed to ensure that the fuel has good conveying properties. An intimate contact between coal granules and absorbent is provided. When the fuel has been fed into the bed, the $Ca(OH)_2$ is again decomposed at about 600° C., creating CaO in contact with the coal granules where it is ready to absorb sulfer. The intimate bond to the coal granules discourages any blowing away of the fine-grained absorbent and results in a very good utilization of the absorbent.

The method of the invention is particularly advantageous when, in the absence of dolomite or having regard to the economics of the process—limestone must be used as the bed material. In addition to being able to use a simpler device for discharging the bed material, a simpler and smaller drying plant can also be used.

A combustion plant according to the invention comprises a combustion chamber, usually enclosed in a pressure vessel, having means for discharging bed material. Further, a mixer is provided where fuel and the discharged bed material are mixed. The plant may either comprise a crusher or mill for fuel and a further crusher or mill for bed material as well as a mixing and drying plant for the crushed material. Alternatively, the plant may include a mixer for the uncrushed material and a crusher or mill for the mixed material. For feeding the mixture of fuel and bed material to the combustion chamber there is provided a pnematic conveying device.

BRIEF DESCRIPTION OF THE DRAWINGS

The invention will now be described in greater detail, by way of example, with reference to the accompanying drawings, in which.

DESCRIPTION OF PREFERRED EMBODIMENTS

Figure 1:
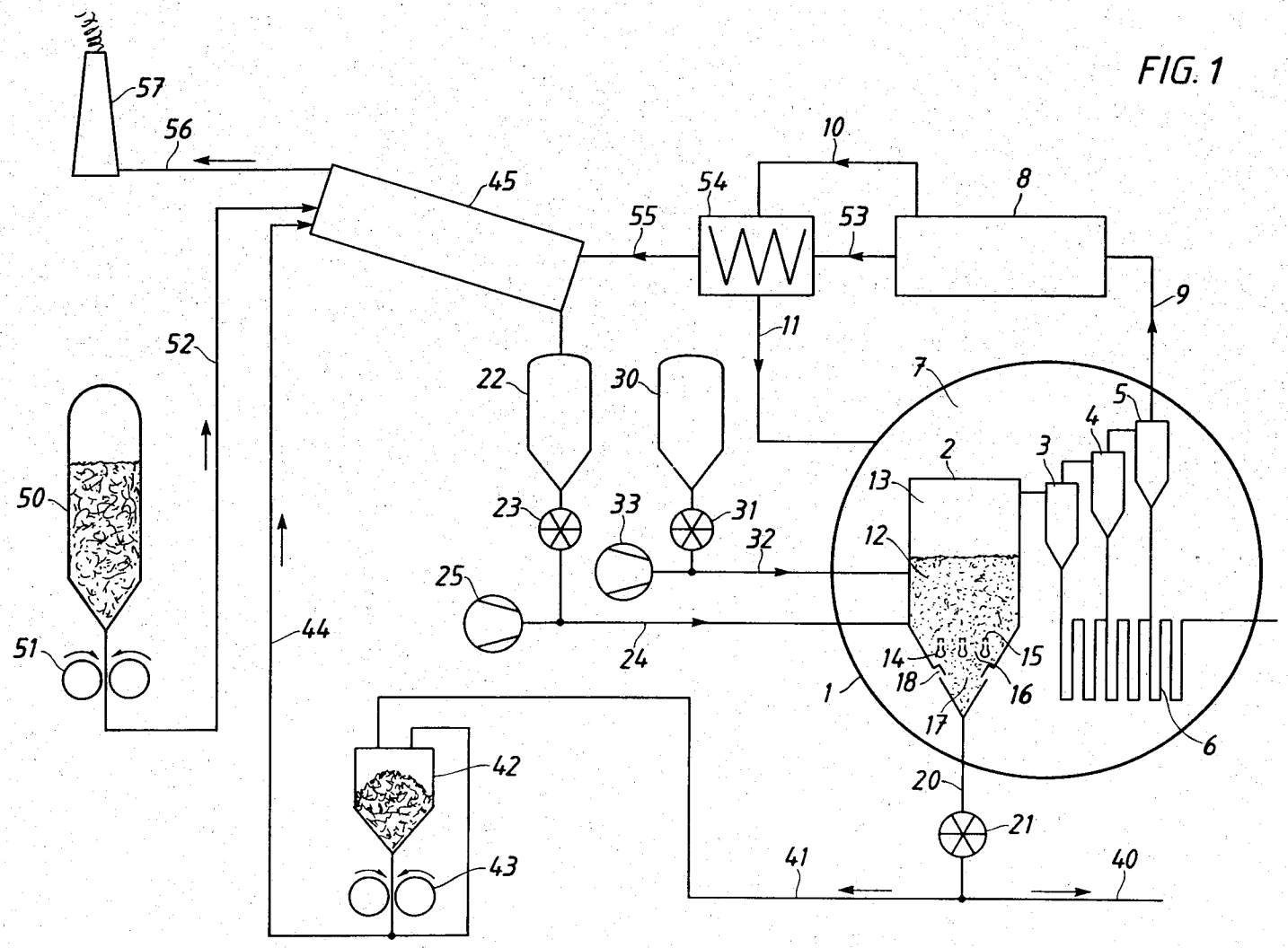
FIGS. 1 and 2 show schematically two alternative embodiments of a PFBC power plant to which the invention is applied.

In the drawings, 1 designates a pressure vessel having a combustion chamber 2 and a cleaning plant for combustion gases leaving the chamber 2. The cleaning plant consists of a number of groups of series-connected cyclones shown schematically at 3, 4 and 5. The cyclones 3, 4 and 5 are connected at their lower ends to an ash discharge device 6 and a collection container (not shown) for seperated dust.

The space 7 within the vessel 1 is pressurized and is fed with combustion air via conduits 10 and 11 from a plant 8 containing a number of gas turbine-propelled compressors and a gas-turbine-propelled generator. Propellant gas is supplied to the turbines in the plant 8 from the cyclone 5 of the cleaning plant via a conduit 9.

The lower part of the combustion chamber 2 includes a fluidized bed 12 and above this there is a plenum space 13 for the combustion gases. The combustion chamber 2 includes a number of parallel air plenum chambers 14 with nozzles 15, through which air is supplied for fluidizing the bed 12 for promoting combustion of the fuel supplied to the bed 12. Between the chambers 14 gaps 16 are provided through which bed material drops down to a space 17 in the lowermost part of the combustion chamber 2. This space 17 is provided with openings 18, through which cooling air from the space 7 may enter the space 17 for cooling the down-flowing bed material which, after this cooling, is extracted via a conduit 20 and a sluice valve 21.

From a container 22, a mixture of dried fuel and crushed bed material is extracted, and the bed material used for the drying is fed pneumatically to the fluidized bed 12 via a sluice valve 23 and a conduit 24. Transport gas, at the necessary pressure, is obtained from a compressor 25. From a bed material container 30, fresh bed material is pneumatically fed to the bed 12 via a sluice valve 31 and a conduit 32. Transport gas at the necessary pressure for the conduit 32 is obtained from a compressor 33. Some of the bed material removed from the combustion chamber 2 via the conduit 20 and the sluice valve 21 can be transported via a conduit 40 to a deposit container (not shown).

In the embodiment shown in FIG. 1, some of the extracted bed material is conveyed through a conduit 41 to a container 42, whence it is ground in a mill 43 and conveyed through a conduit 44 to a mixing and drying cylinder 45. Fuel from a container 50 is ground in a mill 51 and conveyed in a conduit 52 to the mixing and drying cylinder 45. From the cylinder 45, the material is transferred to the container 22. The fuel should be crushed or ground to a grain size less than 5 mm. For the best drying result, the bed material is suitably finely-ground so that 90% thereof has a grain size less than 0.1 mm.

Integers 53 to 57 shown in FIG. 1 are described in the embodiment to be discussed with reference to FIG. 2.

Figure 2:
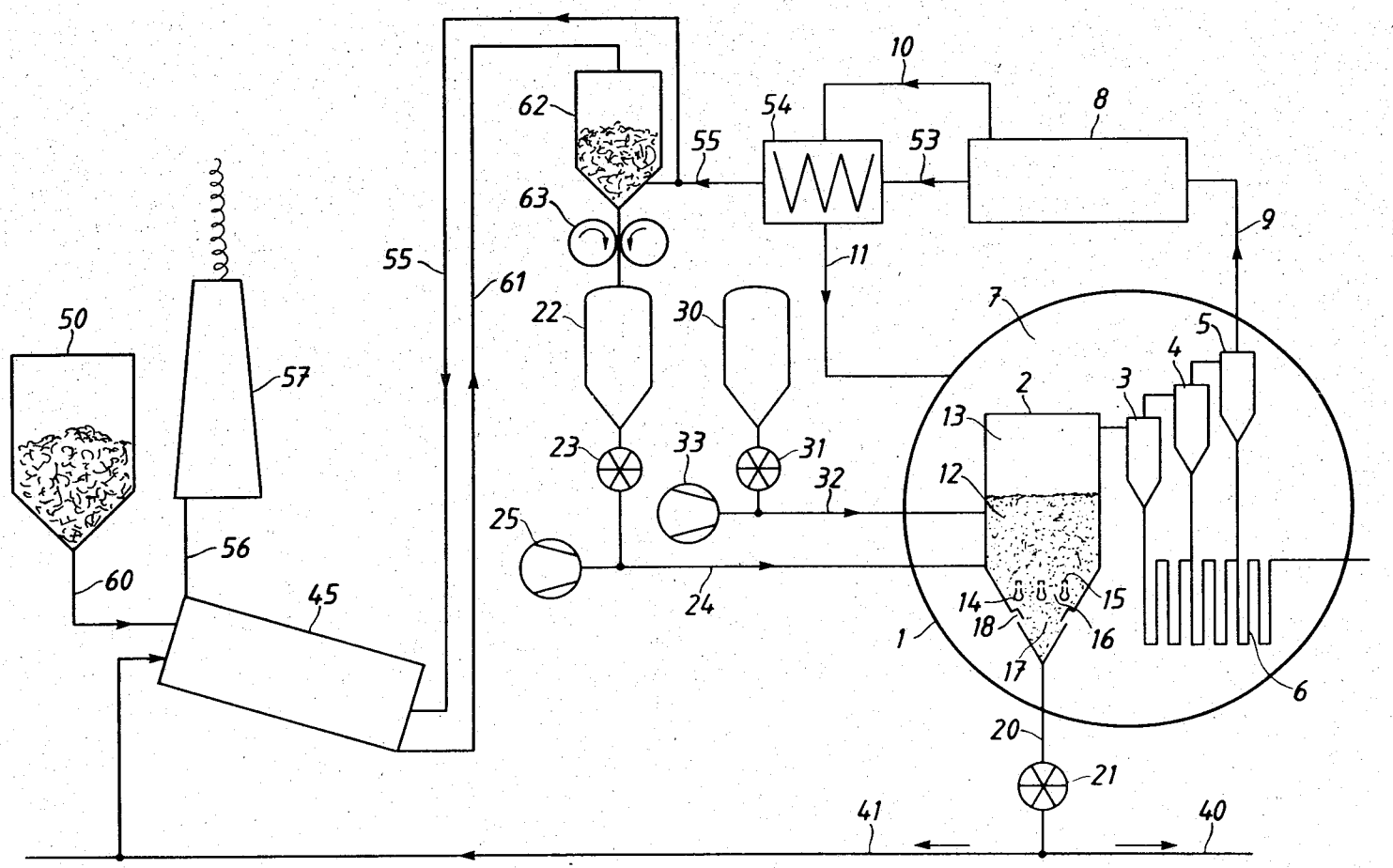

In the embodiment shown in FIG. 2, the bed material conveyed through the conduit 41 is fed directly to the mixing and drying cylinder 45. Uncrushed fuel from the container 50 is conveyed via a conduit 60 directly to the cylinder 45 where the fuel and bed material are mixed. This mixture of fuel and bed material from the cylinder 45 is conveyed in a conduit 61 to the container 22 and is ground together in a mill 63 and transferred to the container 22. A disadvantage is that both fuel and bed material will be crushed to the same size, which means that optimum conditions cannot always be achieved.

The drying of the fuel is accomplished partly due to the fact that calcium oxide absorbs water according to $CaO+H_2O \rightarrow Ca(OH)_2+65$ kJ/mole and partly due to the fact that the heat developed during this reaction evaporates moisture from the coal. The cylinder 45 may be supplied with additional drying heat by utilizing exhaust gases from the turbine in the plant 8. These exhaust gases from the plant are passed through a conduit 53 to an air preheater 54 and from there to a conduit 55 and fed to the cylinder 45, where the exhaust gases are removed partly by the moisture evaporated by the chemical exothermic reaction and partly by the moisture evaporated by the additional supply of heat. From the rotary dryer, the gases are passed via a conduit 56 to a chimney 57. In the embodiment shown in FIG. 2 it may be desirable to allow the flue gases to heat the milling plant 63.

Figure 3:
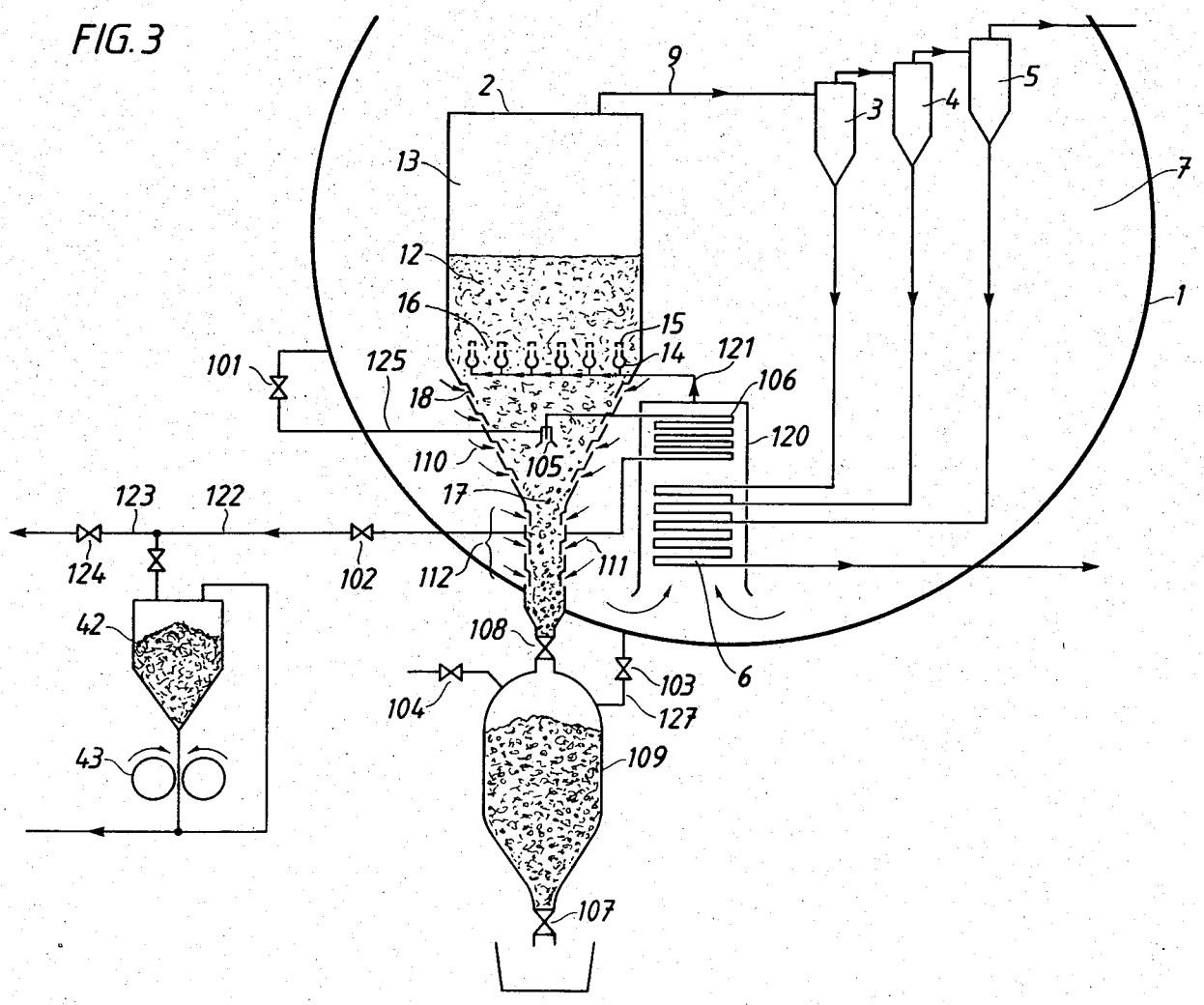
FIG. 3 shows part of a plant having an embodiment which differs slightly from the embodiment of either of FIGS. 1 and 2.

In the embodiment shown in FIG. 3, bed material is discharged from the space 17 via a discharge nozzle 105 and a cooled pressure-reducing discharge device 106 of the same type as the ash discharge device 6. The bed material discharge device 106 and the ash discharge device 6 are arranged in a common air channel 120, through which the combustion air is upwardly passed and is forwarded from here through conduits 121 to the air plenum chambers 14 provided with the air nozzles 15. From the discharge device 106, the bed material is conducted through a conduit 122 with a valve 102 to the container 42, or alternatively further through a conduit 123 with a valve 124 to a collection container (not shown). Through a conduit 125 with a valve 101, the nozzle 105 can be supplied with compressed air from the space 7 for controlling the bed material flow. The bed material flow is decreased by the supply of air to the nozzle 105 and may be interrupted completely by shutting the valves 101 and 102. The space 17 includes a discharge part 112 with inlet openings 111, through which cooling air from the space 7 is supplied. This discharge part is connected via a valve 108 to a lock hopper container 109 for slag lumps. The container 109 may be pressurized with air from the space 7 in the container 1 via a conduit 127 provided with a valve 103 and be relieved via a valve 104. The container 109 may be emptied via a valve 107.

The cooling air, marked with arrows 110, which is supplied to the space 17 in the cooled bottom part in the combustion chamber, provides a zone with a temperature of 700°–800° C. and an atmosphere with a low $CO_2$ content, so that favorable conditions for calcination are obtained. Complete or almost complete calcination may be obtained. The cooling air which is supplied to the discharge part 112 serves to cool slag lumps and separate them from bed material. Air is suitably supplied in such an amount that a fluidized bed with a fluidizing rate of 5–10 m/s is obtained in the discharge part 112. The necessary air quantity is only a few per cent of the entire air flow supplied to the combustion chamber. Slag lumps of such a size that they cannot suitably be fed out through the discharge device 106 are concentrated in the discharge part 112 and are discharged via the lock hopper 109.

The nozzle 105 may be positioned at various places within the combustion chamber, some of which can be above the fluidizinCg bottom provided with the nozzles 15. By the supply of air to the nozzle 105, the $CO_2$ concentration may be controlled so that the calcination conditions are favorable and the desired degree of calcination is achieved in connection with the discharge.

As a result of friction and deceleration occuring at the bends between the different tube parts, a certain grinding effect is achieved on the bed material in the discharge device 106. This effect may be increased by suitale design. For example, hard materials, against which bed material can be abraded and broken down, may be arranged at preferred locations in the discharge device 106.

The exhaust gases from the gas turbines in the plant 8 may alternatively be utilized for heating feed water in a steam unit included in the PFBC plant.

The embodiments illustrated in FIGS. 1 and 2 can ech incorporate the arrangement shown in FIG. 3, and since various modifications can clearly be made to the illustrated designs, it should be appreciated that the illustrated embodiments are purely exemplary of the inventions, all such modifications falling within the scope of the following claims being within the spirit and scope of the invention.

What is claimed is:

1. A method of improving the pneumatic conveying properties of a particulate fuel fed to a pneumatically fluidized combustion bed in a combustion chamber, the fuel particles prior to feeding containing moisture and the fluidized combustion bed containing particulate bed material comprising calcium carbonate, said method comprising withdrawing a fluidized portion of said bed material directly from said pneumatically fluidized combustion bed in the combustion chamber, subjecting said withdrawn portion to calcining conditions to at least partially calcine said bed material to provide calcium oxide in said withdrawn portion, crushing said withdrawn bed material to expose said calcium oxide, mixing said crushed bed material with said fuel particles containing moisture to dry the particulate fuel by reacting said calcium oxide with said moisture at the surface of said fuel particles, contacting said mixture of crushed bed material and moist particulate fuel with a supply of drying gas to aid in the drying of said fuel, and supplying said mixture of crushed bed material and dried particulate fuel to the combustion chamber via a pneumatic conveying means, the drying provided by said crushed bed material and said drying gas reducing the moisture content of said particulate fuel sufficiently to prevent clogging of said pneumatic conveying means.

2. A method according to claim 1, in which the withdrawn bed material is passed through a zone with a low $CO_2$ content during said calcining.

3. A method according to claim 2, in which the temperature in the low $CO_2$ content zone is between 700° C. and 800° C.

4. A method according to claim 1, in which combustion air is fed into a discharge device for withdrawing said portion of the bed material to cool the bed material during its withdrawal.

5. A method according to claim 1, which further comprises drying said mixture of crushed bed material and fuel with a drying gas, and in which said particulate fuel is crushed coal and said crushed coal is mixed with finely crushed bed material in a rotary mixer which is transversed by said drying gas.

6. A method according to claim 1, in which at least 90% of the crushed bed material has a grain size of less than 0.1 mm.

7. A method according to claim 1, which further comprises drying said mixture of crushed bed material and fuel with exhaust gases from the combustion chamber.

8. A method according to claim 1, which further comprises drying said mixture of crushed bed material and fuel with transport gas from an ash discharge system connected to the combustion chamber.

9. A method according to claim 1, in which said withdrawn bed material and said particulate fuel are mixed and crushed together in a common mill.

10. A method according to claim 1, in which said calcining conditions are such tht substantially complete calcination of said withdrawn bed material is obtained.

11. A method according to claim 1, in which at least 90% of the crushed bed material has a grain size of less than 0.1 mm and substantially all of said particulate fuel has a grain size of less than 5 mm.

12. An apparatus for improving the pneumatic conveying properties of a particulate fuel fed to a pneumatically fluidized combustion bed in a combustion chamber, the fuel particles prior to feeding containing moisture and the fluidized combustion bed containing particulate bed material comprising calcium carbonate, said apparatus comprising means for withdrawing a fluidized portion of said bed material directly from said pneumatically fluidized combustion bed in the combustion chamber, means for subjecting said withdrawn portion to calcining conditions to at least partially calcine said bed material to provide calcium oxide in said withdrawn portion, means for crushing said withdrawn bed material to expose said calcium oxide, mixing means for mixing said crushed material with said fuel particles containing moisture to dry the particulate fuel by reacting said calcium oxide with said moisture at the surface of said fuel particles, means for supplying a drying gas to said mixing means to aid in the drying of said particulate fuel, and pneumatic conveying means for supplying said mixture of crushed bed material and dried fuel to the combustion chamber, the drying provided by said crushed bed material and said drying gas reducing the moisture content of said particulate fuel sufficiently to prevent clogging of said pneumatic conveying means.

13. An appartus according to claim 12, in which said particulate fuel comprises a sulphur and moisture containing coal, in which said fluidized bed material comprises a sulphur absorbent particulate material comprising calcuim carbonate, and in which said apparatus further comprises means for generating calcining conditions for the sulphur absorbent material within a calcining portion of said combustion chamber below said combustion bed to provide calcium oxide in the sulfur absorbent material within said calcining portion of the combustion chamber, and means for supplying said calcined sulfur absorbent material from said calcining portion of the combustion chamber to said crushing means.

14. An apparatus according to claim 12, including means for mixing together crushed fuel and crushed bed material.

15. An apparatus according to claim 12, including means for mixing uncrushed fuel and uncrushed bed material and a crushing device for crushing the mixture of fuel and bed material.

16. An apparatus according to claim 12, further including an inclined, rotary cylinder which is supplied with coal, bed material and a drying gas.

* * * * *